United States Patent [19]

Church

[11] Patent Number: 4,741,528

[45] Date of Patent: May 3, 1988

[54] ARCHER'S EXERCISE DEVICE

[76] Inventor: Bobby C. Church, Rte. 1, Box 809, Panama City, Fla. 32404

[21] Appl. No.: 61,143

[22] Filed: Jun. 12, 1987

[51] Int. Cl.[4] ..... A63B 21/06

[52] U.S. Cl. ..... 272/118; 272/117; 124/23 R

[58] Field of Search ..... 272/116, 117, 118, 123, 272/142, 143; 124/1, 23 R; 434/247

[56] References Cited

U.S. PATENT DOCUMENTS

| | | | |
|---|---|---|---|
| 2,763,156 | 9/1956 | Garigal | 124/23 R |
| 3,019,019 | 1/1962 | Forte | 272/117 |
| 3,235,255 | 2/1966 | Leflar | 272/123 |
| 3,294,399 | 12/1966 | Cugliari | 272/117 |
| 3,633,907 | 1/1972 | Cane | 272/142 |
| 3,717,342 | 2/1973 | Haney et al. | 272/118 X |
| 3,782,719 | 1/1974 | Kuhlman | 272/67 |
| 3,966,203 | 6/1976 | Bickford | 272/118 |
| 4,154,441 | 5/1979 | Gajda | 272/117 X |
| 4,174,832 | 11/1979 | Thompson | 272/140 X |
| 4,279,601 | 7/1981 | Cobelli | 434/247 |
| 4,328,965 | 5/1982 | Hatfield | 272/142 X |
| 4,334,678 | 6/1982 | Doyel | 272/141 |
| 4,353,546 | 10/1982 | Rhoades | 272/117 |
| 4,564,194 | 1/1986 | Dawson | 272/117 X |
| 4,577,861 | 5/1986 | Bangerper et al. | 272/67 X |
| 4,591,149 | 5/1986 | Godfrey | 272/118 |

FOREIGN PATENT DOCUMENTS

| | | | |
|---|---|---|---|
| 735331 | 5/1966 | Canada | 272/117 |
| 611623 | 6/1978 | U.S.S.R. | 272/117 |

OTHER PUBLICATIONS

Article on the "Archerciser" in Archery World, Sep. 1979, pp. 24–25.

Advertisement for "Bow Pulling Power Builder" by Dick Palmer Archery, Nov. 1981.

*Primary Examiner*—Richard J. Apley
*Assistant Examiner*—Robert W. Bahr
*Attorney, Agent, or Firm*—Arthur G. Yeager

[57] ABSTRACT

Device to exercise the muscles involved in pulling an archery bow comprising a stationary elongated vertical tubular post with a short tubular section telescopically surrounding the post and slideable vertically up and down the post, an elongated vertical slot opening in the post, a plate fastened to the short outside section with one end extending inwardly through the slot opening and having an eye on the vertical axis of the post, a flexible cable tied to the eye and extending upwardly along the axis of the post and over a pulley at the top of the post and outwardly to a handle resembling the bowstring an archer would pull when shooting an arrow, a fixed handle on the upper end of the post resembling the center of a bow held by the archer when pulling the bowstring in shooting an arrow, and a plurality of weights slideably attachable to the short tubular section to load the device to resemble the load required to shoot an arrow.

18 Claims, 1 Drawing Sheet

ARCHER'S EXERCISE DEVICE

BACKGROUND OF THE INVENTION

The actions required in shooting a long bow are well known. For a right handed archer his left hand grasps the center of the bow and the fingers of his right hand grip the center of the bowstring and pull it back to the full extent necessary to shoot the arrow to the target. The normal exercise devices for the shoulders and arms are not specifically designed to develop the muscles used in archery, but rather generally to strengthen the deltoid, biceps, triceps, pectoralis and the trapezius. In the movements involved in archery, the arms and shoulders go through specific motions which are not usually included in general exercise routines.

It is an object of this invention to provide an exercise device designed Specifically to exercise the muscles used in pulling a bow. It is another object of this invention to provide an unobtrusive exercise device that can be placed in any room of the house. Still other objects will become apparent from the more detailed description which follows.

BRIEF SUMMARY OF THE INVENTION

This invention relates to an archer's exercise device comprising an elongated vertical tubular post having a top and a bottom and a linear elongated slotted passageway through the wall of said post and extending from said top to adjacent said bottom; a tubular weight support concentrically surrounding said post adjacent said bottom and slideable vertically on said post, said weight support having a top and a bottom with an outwardly extending base adjacent its bottom and adapted to support dead weights placed thereon around said tubular portion, said weight support adjacent its top having an anchoring means for attachment of a flexible cable thereto positioned on the axis of said tubular post, said anchoring means being adapted to slide vertically in said slotted passageway; a pulley at said top of said tubular post; a flexible cable attached to said anchoring means and extending upwardly, around said pulley and outwardly beyond said pulley to terminate in a handle adapted to resemble the center of a bowstring which is pulled away from the bow in shooting an arrow from a bow, said tubular post having rigidly affixed thereto a bow handle resembling that of the central portion of a bow, and a plurality of weights adapted to be slideably placed on said weight support.

In specific embodiments of this invention the handle at the free end of the cable is a loop of the cable held open by a spreader bar; a cylindrical container to hold the weights in place attached to the weight support; and a locking means is included to facilitate moving the device around.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

The detailed operational features of this invention are best understood by reference to the attached drawings described above.

The backbone of the exercise device is a vertical tubular post 12, preferably steel square tubing of about 0.75 inch on a side with walls about 0.0625 inch thick. Round tubing is also operable. The tubing may optionally be aluminum although slightly larger size, e.g., one inch on a side by about 0.125 inch wall thickness is recommended to provide the necessary strength. A continuous slot opening 13 is cut through the wall and extends vertically throughout the length of post 12, preferably about 0.250 inch wide. Post 12 has an upper end 26 and a lower end 27, the total length of post 12 being about 50–60 inches.

Figure 4:
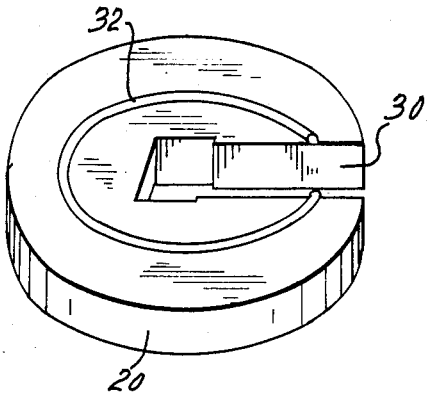
FIG. 4 is a perspective view of one of the weights used with this invention.

A short weight support tubular section 15 slides telescopically up and down post 12. The shape of section 15 is, therefore, the same as that of post 12, i.e., both are square tubing or both are circular tubing. The size of section 15 is that which will slide easily over post 12, e.g., if post 12 is 0.75 inch square tubing, section 15 should be 1.0 inch square tubing. Section 15 serves as a support for the weights used in the exercise device which generally will total 40–60 lbs. Section 15 has a flange 16 affixed, as by welding, to its bottom edge. Flange 16 supports the weights placed around section 15. Weights 20 are shown in FIG. 4 as square disc-shaped, preferably made of cast iron. A radial slot 30 is in each weight to permit it to be slid around section 15. A bead 32 may be formed in the top of weight 20 and a corresponding groove in the bottom of weight 20 so that a stack of weights 20 will have some stability against sliding apart. The groove in one weight 20 will receive the bead 32 in the next adjacent weight 20.

At the top of section 15 there is an anchoring means 14 to which is attached the lower end of a flexible cable 11. Preferably anchoring means 14 has an arcuate shape with a hole 25 which is generally on the axis of post 12 and the other end of means 14 is welded or otherwise rigidly attached to section 15. Instead of hole 25 there might be used a hook on the end of means 14 or any other feature to which flexible cable 11 can be attached. In the use of the exercise device as will be explained below, section 15 with weights 20 thereon will move up and down post 12, and anchoring means 14 will move along with section 15 with the nose 33 moving up and down through vertical slot opening 13. Accordingly, nose 33 should be thinner than the width of opening 13. A convenient material for anchoring means 14 is a metal, e.g., steel, plate of about 0.25 inch in thickness. The lower part 34 of anchoring means 14 may be much wider, e.g., formed into a flange, so as to provide a large surface for welding or bolting to section 15.

A flexible cable 11 connects post 12 to section 15. The lower end of flexible cable 11 is tied to or otherwise affixed to hole 25 of anchoring means 14. Cable 11 preferably is the same material as a bowstring in order to provide the same feeling to the archer when using the exercise device. Other cables can be employed, e.g., steel cable, rope, or the like. At the upper end 26 of post 12 there is a pulley 19 over which cable 11 runs. If cable 11 should be a chain, pulley 19 will be a sprocket to cooperate with the chain. The free end of cable 11 is attached to or formed into a handle to resemble, as closely as possible, the center of the bowstring which is grasped by the archer when pulling back the bowstring to shoot the arrow. A preferred arrangement is to prepare a loop 10 of cable 11 and insert a spreader bar 31 to maintain the loop 10 in an open position similar to the shape of the bowstring when it is fully drawn back in the shooting position.

A bow handle 17 is permanently affixed to post 12 immediately below pulley 19. Handle 17 should resemble the center of the bow which is held in one hand by the archer while pulling back the bowstring with the other hand.

Figure 1:
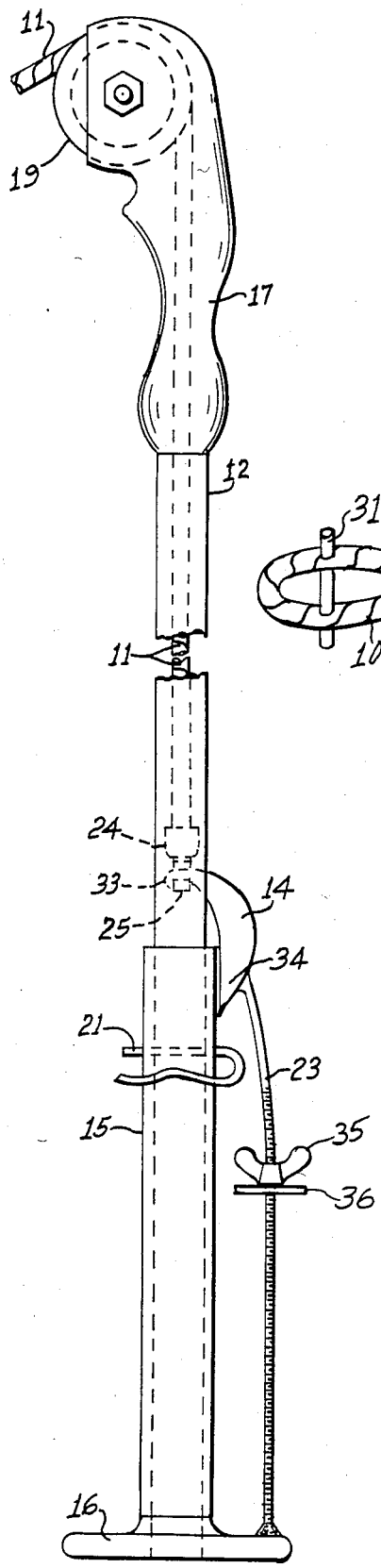
FIG. 1 is a side elevational view of the exercise device of this invention.
Figure 2:
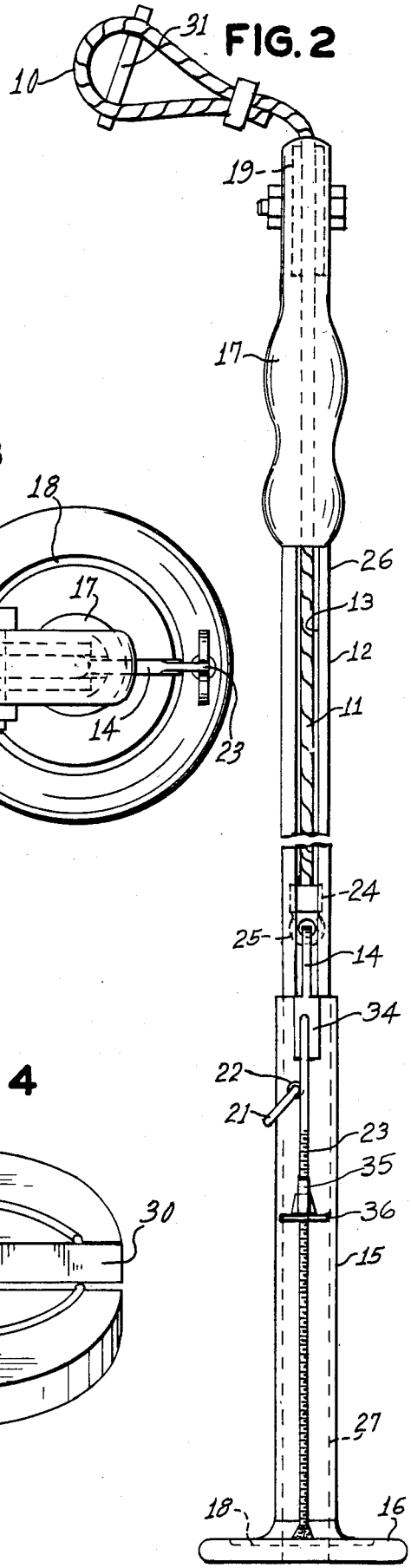
FIG. 2 is a front elevational view of the exercise device of this invention.
Figure 3:
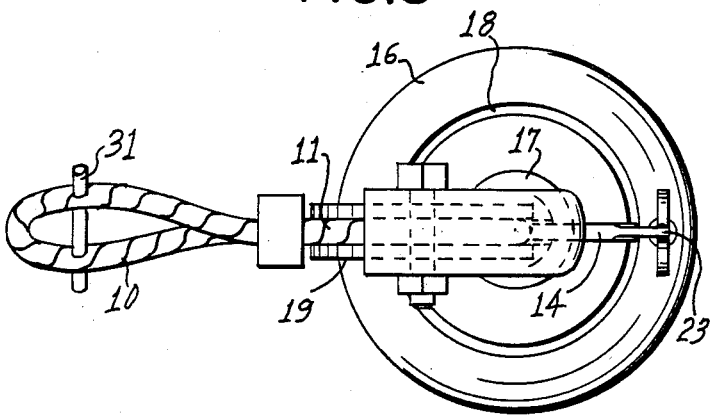
FIG. 3 is a top plan view of the exercise device of this invention.

The other features which are shown in the drawings are preferred, but optional. They include a common hole 22 through both post 12 and section 15 and a cotter pin 21 to fit hole 22. The cotter pin 21 is used when the exercise device is not in use so as to immobilize section 15 with respect to post 12, e.g., when moving the device from place to place. Handle 23 is convenient for use when moving the device. Handle 23 can be a threaded rod welded or bolted at each end to components of section 15. In FIG. 2 handle 23 is welded to anchoring flange 16 at the lower end. Weights 20 may be of any design which is usable on this device. The usual design is a square or round disc having a radial slot 30 large enough to slide around section 15, and normally including an upwardly projecting bead 32 which fits into a corresponding groove (not shown) in the bottom of the weight 20. Preferably for this device container 18 will hold about 40 lbs. of weight (the recommended minimum for this device) and other weights of 2½ to 5 lbs. in size are available to stack on top of those weights supported by 16. Wing nut 35 with large washer 36 attached thereto, on handle 23 is employed to hold weights 20 down against flange 16.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An archer's exercise device comprising an elongated vertical tubular post having a top and a bottom and a linear elongated slotted passageway through the wall of said post and extending from said top to adjacent said bottom; a tubular weight support concentrically surrounding said post adjacent said bottom and slideable vertically on said post, said weight support having a top and a bottom with an outwardly extending base adjacent its bottom and adapted to support dead weights placed thereon around said tubular portion, said weight support having an anchoring means adjacent its top for attachment of a flexible cable thereto positioned on the axis of said tubular post, said anchoring means being adapted to slide vertically in said slotted passageway; a pulley at said top of said tubular post; a flexible cable attached to said anchoring means and extending upwardly around said pulley and outwardly beyond said pulley to terminate in a handle adapted to resemble the center of a bowstring which is pulled away from the bow in shooting an arrow from a bow, said tubular post having rigidly affixed thereto a bow handle resembling that of the central portion of a bow, and a plurality of weights adapted to be slideably placed on said weight support.

2. The archer's exercise device of claim 1 which additionally comprises a selectively operable locking means to prevent relative slideable movement between said tubular post and said tubular weight support.

3. The archer's exercise device of claim 1 which additionally comprises a handle for carrying said device, said handle being generally parallel to said tubular post.

4. The archer's exercise device of claim 4 which includes a handle for carrying said device which is attached at one end to said anchoring means and at the other end to said outwardly extending base.

5. The archer's exercise device of claim 1 wherein said anchoring means comprises an arcuate plate affixed at one end to said tubular weight support and having an eye at the other end on the common axis of said weight support and said tubular post.

6. An archer's portable exercise device to develop muscular strength for pulling a bow, said device comprising an elongated, vertically positioned, square tubular post having an upper end and a lower end, an elongated vertical opening through the wall of said tubular post extending from said upper end to adjacent said lower end; a short square tubular section telescopically and vertically slideably surrounding said post and having a weight supporting flange extending horizontally outwardly therefrom; an arcuate plate affixed to the upper end of said short tubular section and projecting inwardly of said tubular post through said vertical opening and having an eye in said plate substantially aligned with the axis of said tubular post; a pulley affixed to the said upper end of said post, a flexible cable attached at one end to said eye and extending upwardly over said pulley, to a free end outwardly of said device and of said pulley and having a handle simulating a bowstring where the archer pulls it toward him to shoot an arrow; a contoured solid handle affixed to said upper end of said post adjacent said pulley, said contoured handle simulating the center handle of a bow; and a plurality of weights slideably attachable to said short square tubular section.

7. The exercise device of claim 6 which additionally comprises a carrying handle for said device fastened at one end to said arcuate plate and at the other end to said flange.

8. The exercise device of claim 6 which additionally comprises a hole through said post and said short tubular section and a cotter pin means adapted to slide into said hole to prevent relative vertical movement between said post and said short tubular section.

9. The exercise device of claim 6 wherein said flexible cable closely resembles a bowstring and said handle at the free end of said flexible cable comprises a loop of said cable with a spreader bar holding said loop open.

10. An archer's exercise device comprising an elongated vertical tubular hollow post having an upper portion and a lower portion and a linear elongated slot through a wall of said post and extending between said upper and lower portions; a tubular weight support concentrically surrounding said post adjacent said lower portion and slideable vertically on said post, said weight support having a top and a bottom with an outwardly extending base adjacent its bottom and adapted to support dead weights placed thereon around said tubular portion, said weight support having an anchoring means adjacent its top, an elongated flexible cable attached at one end to said anchoring means and extending along a longitudinal axis of said tubular post, said anchoring means being adapted to slide vertically in said slot; a rotatable pulley mounted to upper portion of said tubular post; said cable extending upwardly around said pulley and laterally outwardly beyond said pulley, a first handle connected to another end of said cable, said handle being formed to simulate a center of a bowstring which is pulled away from a bow in shooting an arrow from a bow, said tubular post having rigidly affixed thereto a second handle simulating a central portion of a bow, and a plurality of weights selectively adapted to be slideably placed on said weight support.

11. The archer's exercise device of claim 10 which additionally comprises a releasable locking means to prevent relative slideable movement between said tubular post and said tubular weight support.

12. The archer's exercise device of claim 10 which additionally comprises a third handle attached to said device for carrying same, said handle being generally parallel to said tubular post.

13. The archer's exercise device of claim 12 wherein said third handle is elongated and having one end attached to said anchoring means and its other end attached to said outwardly extending base.

14. The archer's exercise device of claim 10 wherein said anchoring means includes an arcuate plate affixed at one end to said tubular weight support and having an eye at the other end generally aligned with said longitudinal axis.

15. An archer's portable exercise device to develop muscular strength for pulling a bow, said device comprising an elongated, vertically positioned, square tubular hollow post having an upper end portion and a lower end portion, an elongated vertical slot through a wall of said tubular post extending from said upper end portion to adjacent said lower end portion, a short square tubular section telescopically and vertically slideably surrounding said post and having a weight supporting flange extending horizontally laterally therefrom adjacent a bottom end portion thereof, an arcuate plate affixed to said short tubular section adjacent an upper end portion thereof and projecting inwardly of said tubular post through said vertical slot, said plate having an eye therein substantially aligned with a longitudinal vertical axis of said tubular post, a pulley affixed to the said upper end portion of said post, an elongated flexible cable attached at one end to said eye and extending upwardly over said pulley to a free end outwardly thereof, a handle attached to said free end and simulating a bowstring where an archer pulls it toward him to simulate shooting of an arrow, a contoured solid handle affixed to said upper end portion of said tubular post adjacent said pulley, said contoured handle simulating a center handle of a bow, and a plurality of weights selectively slideably attachable to said short square tubular section and supportable by said flange.

16. The exercise device of claim 15 which additionally comprises a carrying handle fastened at one end to said arcuate plate and at the other end to said flange.

17. The exercise device of claim 15 wherein said post includes an opening through a wall thereof, said short tubular section having another opening through an adjacent wall thereof, said openings being selectively alignable, further comprising a pin means adapted to slide into said aligned openings to prevent relative vertical movement between said post and said short tubular section.

18. The exercise device of claim 15 wherein said flexible cable closely resembles a bowstring, said handle at said free end of said flexible cable being formed by a loop of said cable and a spreader bar holding said loop in an open position.

* * * * *